US006135436A

United States Patent [19]

Hur

[11] Patent Number: 6,135,436

[45] Date of Patent: Oct. 24, 2000

[54] ENVELOPE PRESSING DEVICE IN PRINTER

[75] Inventor: Kiel-Jae Hur, Anyang, Rep. of Korea

[73] Assignee: SamSung Electronics Co., Ltd., Suwon, Rep. of Korea

[21] Appl. No.: 09/222,670

[22] Filed: Dec. 29, 1998

[30] Foreign Application Priority Data

Dec. 29, 1997 [KR] Rep. of Korea ..... 97-75918

[51] Int. Cl.[7] ..... B65H 5/00

[52] U.S. Cl. ..... 271/2; 271/145; 271/167

[58] Field of Search ..... 271/2, 145, 167, 271/123, 220

[56] References Cited

U.S. PATENT DOCUMENTS

| | | | |
|---|---|---|---|
| D. 340,739 | 10/1993 | Kashiwabara . | |
| 4,340,314 | 7/1982 | Berger . | |
| 4,362,100 | 12/1982 | Wu et al. . | |
| 4,431,323 | 2/1984 | Kulow . | |
| 4,511,135 | 4/1985 | Huerta et al. . | |
| 4,522,382 | 6/1985 | Chu et al. . | |
| 4,585,223 | 4/1986 | Tam . | |
| 4,603,846 | 8/1986 | Miles . | |
| 4,640,502 | 2/1987 | Habich et al. . | |
| 4,671,504 | 6/1987 | Lapinski et al. . | |
| 4,733,310 | 3/1988 | Kapp et al. . | |
| 4,763,585 | 8/1988 | Miciukiewixz . | |
| 4,843,962 | 7/1989 | Neelman et al. . | |
| 4,930,762 | 6/1990 | Itchens . | |
| 5,026,042 | 6/1991 | Miller . | |
| 5,069,434 | 12/1991 | Sellers . | |
| 5,219,156 | 6/1993 | Mori | 271/110 |
| 5,295,674 | 3/1994 | Zoltner . | |
| 5,419,645 | 5/1995 | Russo . | |
| 5,450,187 | 9/1995 | Pei et al. . | |
| 5,520,381 | 5/1996 | Lo et al. . | |
| 5,527,029 | 6/1996 | Bortolotti et al. . | |
| 5,544,874 | 8/1996 | DeFigueiredo | 271/2 |
| 5,640,664 | 6/1997 | Ukei et al. | 271/2 |
| 5,755,433 | 5/1998 | Klein . | |

FOREIGN PATENT DOCUMENTS

| | | | |
|---|---|---|---|
| 57-180538 | 6/1982 | Japan | 271/145 |

*Primary Examiner*—Donald P. Walsh
*Assistant Examiner*—David A Jones
*Attorney, Agent, or Firm*—Robert E. Bushnell, Esq.

[57] ABSTRACT

The present invention is directed to an envelope pressing device in a printer having a paper cassette which is loaded with a plurality of envelopes and feeds the envelopes one by one by means of a pickup roller. The envelope pressing device includes a hinge shaft rotatably connected to the lower surface of a body frame. In the device, a pressing plate is rotatably connected to the hinge shaft for pressing down on the envelopes. The pressing plate has first and second holes of a predetermined size formed on both side surfaces thereof and a slot formed on one side surface thereof. A lever shaft is inserted into the first and second holes. A lever plate is fixed to an end of the lever shaft and has a third hole formed on a side surface thereof and a fourth hole formed below the third hole. A first spring is wound around the lever shaft and has one end inserted into the third hole and the other end inserted into the slot of the pressing plate. A second spring has one end inserted into the fourth hole and the other end connected to a side surface of the body frame for returning the lever shaft to an original position.

20 Claims, 3 Drawing Sheets

ENVELOPE PRESSING DEVICE IN PRINTER

CLAIM OF PRIORITY

This application makes reference to, incorporates the same herein, and claims all benefits accruing under 35 U.S.C. §119 from an application for ENVELOPE PRESSING DEVICE IN PRINTER earlier filed in the Korean Industrial Property Office on the 29$^{th}$ of December 1997 and there duly assigned Serial No. 75918/1997.

BACKGROUND OF THE INVENTION

1. Technical Field

The present invention relates to a printer having a paper cassette and, in particular, to an envelope pressing device in a printer. The pressing device presses down on the closure flaps of envelopes with a predetermined force when the envelopes are fed.

2. Related Art

Generally, a printer is equipped with a paper cassette for feeding paper. The paper cassette is loaded with a stack of paper, and is inserted into a printer body. The paper is transferred by a transferring device sheet by sheet, and then images are formed on the paper by an image forming portion of the printer. Guides are provided in the paper cassette for regulating placement of papers of different sizes. An envelope mounting portion is defined at a portion of a paper plate in the paper cassette. A plurality of envelopes stacked in the paper cassette are fed one by one to the printer body by rotation of a pickup roller.

However, the closure flap of an envelope is likely to be unfolded upward while the envelope is being fed. As a result, the envelope may skew or jam, causing mis-feeding.

The following patents are considered to be representative of the prior art, and are burdened by the disadvantages set forth herein: U.S. Pat. No. 4,340,314 to Berger, entitled Envelope Feeding Apparatus, U.S. Pat. No. 4,431,323 to Kulow, entitled Envelope Feeder Method And Apparatus, U.S. Pat. No. 4,362,100 to Wu et al., entitled Envelope Feeder, U.S. Pat. No. 4,511,135 to Huerta et al., entitled Enhanced Envelope Feeding, U.S. Pat. No. 4,522,382 to Chu et al., entitled Sheet And Envelope Feed Apparatus For A Printer And Associated Methods, U.S. Pat. No. 4,585,223 to Tam, entitled Envelope Feeder, U.S. Pat. No. 4,763,575 to Miciukiewicz, entitled Envelope Pressure Plate For Mailing Machine, U.S. Pat. No. 4,603,846 to Miles, entitled Dual-Stream Envelope Feeder, U.S. Pat. No. 4,640,502 to Habich et al., entitled Envelope Hopper For Feed And Delivery, U.S. Pat. No. 4,733,310 to Kapp et al., entitled Paper Sheet And Envelope Feeder Apparatus, U.S. Pat. No. 4,843,962 to Neelman et al., entitled Double-Feed Envelope Guide System For Printing Press, U.S. Pat. No. 4,930,762 to Kitchens, entitled Portable Envelope Feeder, U.S. Pat. No. 5,026,042 to Miller, entitled Sheet Feeder For Copiers And Printers, U.S. Pat. No. 5,069,434 to Sellers, entitled Removable Dual Bin Envelope Feed Tray For AN Image Reproduction Machine, U.S. Pat. No. 5,295,674 to Zoltner, entitled High Capacity Envelope Stacker Apparatus, U.S. Pat. No. 5,419,645 to Russo, entitled Envelope Cassette Tray, U.S. Pat. No. 5,450,187 to Pei et al., entitled Envelope Processing IN A Laser Printer For Higher Reliability, Usability And Throughput, U.S. Pat. No. 5,527,029 to Bortolotti et al., entitled Device For Introducing sheets Or Envelopes Into A Printer, U.S. Pat. No. 5,520,381 to Lo et al., entitled High Capacity, Low Jam Envelope Feeder For Laser Printer, and U.S. Pat. No. 5,755,433 to Klein, entitled Method And Apparatus For High Speed Envelope Printing.

SUMMARY OF THE INVENTION

It is an object of the present invention to provide an envelope pressing device in a printer for pressing down the closure flap of an envelope with a predetermined force when a plurality of envelopes loaded on a paper cassette are fed to a printer body one by one.

To achieve the above object, there is provided an envelope pressing device in a printer having a paper cassette which is loaded with a plurality of envelopes, and which feeds the envelopes one by one by a pickup roller. The envelope pressing device includes a hinge shaft rotatably connected to the lower surface of a body frame. In the device, a pressing plate is rotatably connected to the hinge shaft, and has first and second holes of a predetermined size formed on both side surfaces thereof and a slot formed on one side surface thereof for pressing down the envelopes. A lever shaft is inserted into the first and second holes, and a lever plate is fixed to an end of the lever shaft and has a third hole formed on a side surface thereof and a fourth hole formed below the third hole. A first spring is wound around the lever shaft, and has one end inserted into the third hole and the other end inserted into the slot of the pressing plate. A second spring has one end inserted into the fourth hole and the other end connected to a side surface of the body frame for returning the lever shaft to an original position.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
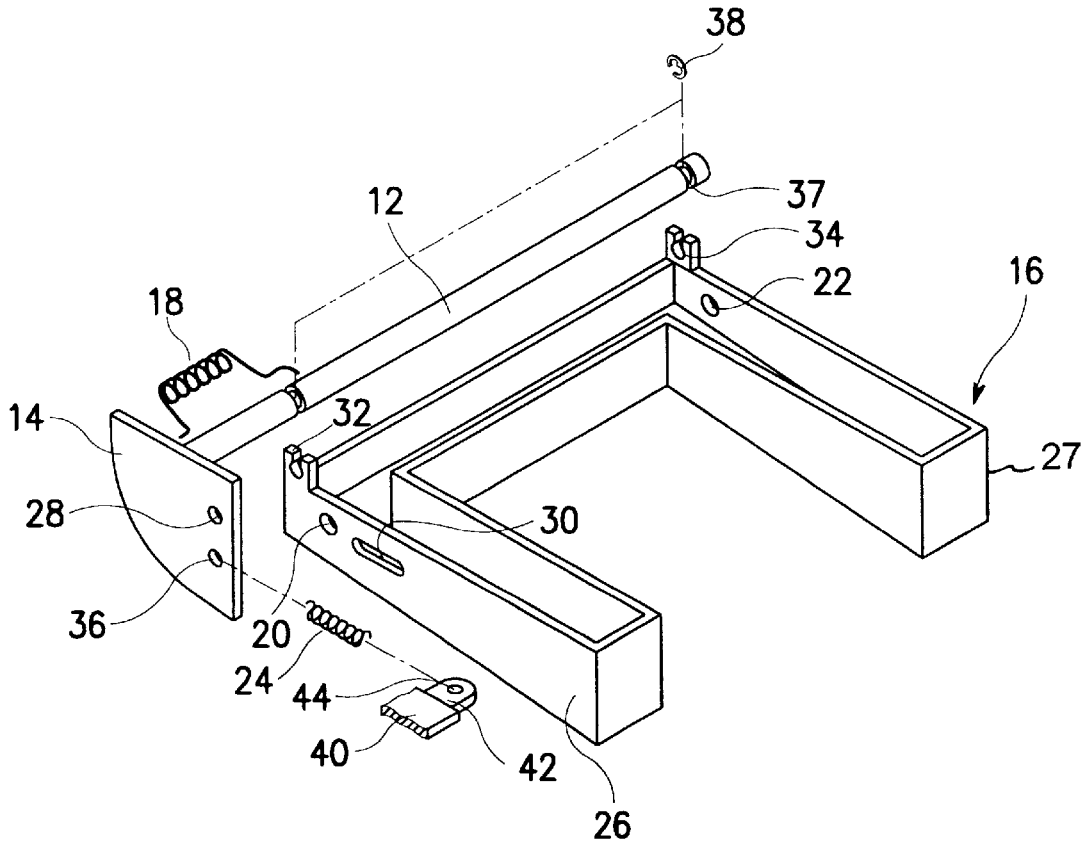
FIG. 1 is an exploded perspective view illustrating elements of an envelope pressing device according to a preferred embodiment of the present invention.
Figure 2:
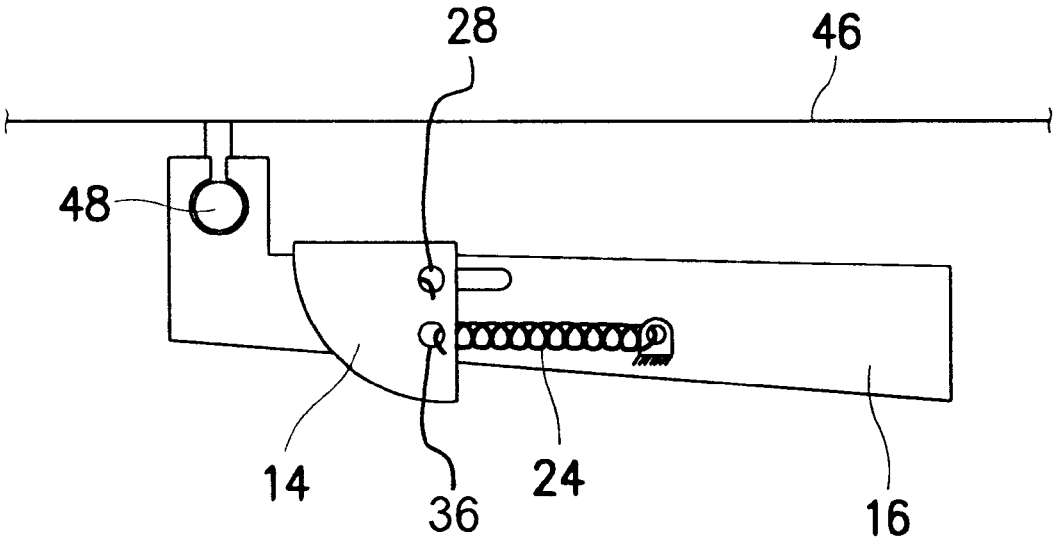
FIG. 2 is a side sectional view of the envelope pressing device in an inoperative mode.
Figure 3:
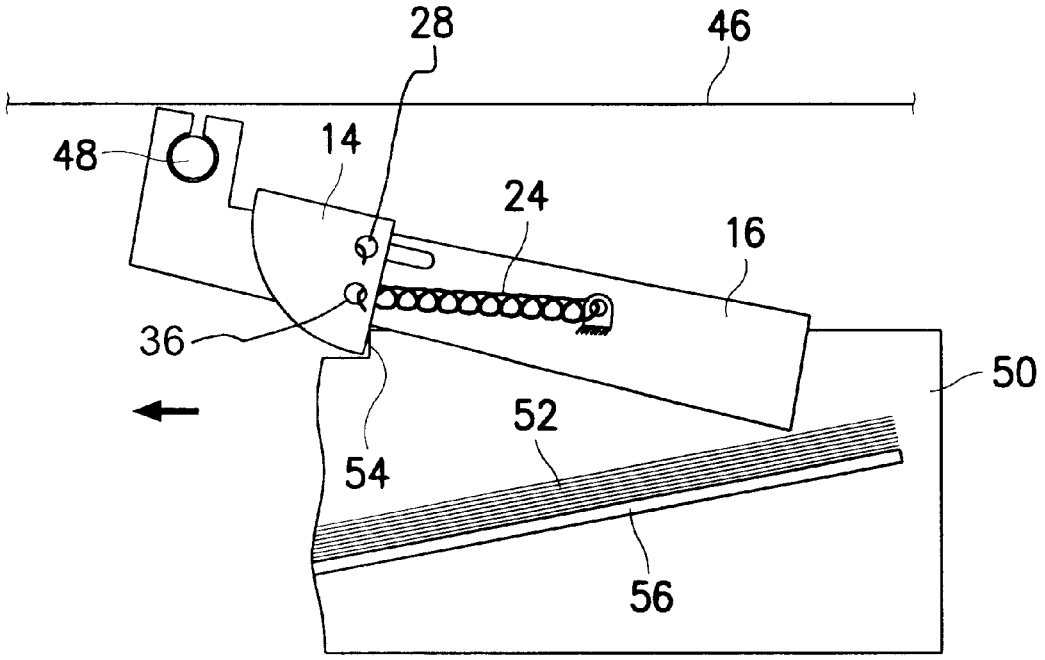
FIG. 3 is a side sectional view of the envelope pressing device in an operative mode.

Referring to FIGS. 1 thru 3, the envelope pressing device is provided on a paper cassette 50 loaded with a plurality of envelopes 52 and inserted into a printer body (not shown). The envelopes 52 are fed one by one by a pickup roller (not shown). The envelope pressing device includes a pressing plate 16, a lever shaft 12, a lever plate 14, a first spring 18, and a second spring 24. The pressing plate 16 is rotatably connected to the lower surface of a body frame 46 by a hinge shaft 48, and presses down on the upper surface of an envelope 52. The pressing plate 16 is shaped like "⊏", opened up, and sloping from one end toward the other end at a predetermined degree or rate of slope so that a side surface 26 of the pressing plate 16 is higher at an envelope pressing portion than at a hinge shaft-connected portion. First and second protrusions 32 and 34 protrude from both ends of one side of the pressing plate 16, and are combined with the hinge shaft 48 so as to be rotatably connected to the lower surface of the body frame 46. The lever shaft 12 is inserted into first and second holes 20 and 22 of a predetermined size formed on respective side surfaces 26 and 27 of the pressing plate 16. Two grooves 37 are formed around the outer circumference of the lever shaft 12 at both end portions thereof, and snap rings 38 fit around the grooves 37 to prevent the lever shaft 12 from moving axially. The lever plate 14 is fan-shaped and fixed to one end of the lever shaft 12. An end portion of the lever plate 14 makes contact with a protrusion 54 on the paper cassette 50. Third and fourth holes 28 and 36 of a predetermined size are formed on a side surface of the lever plate 14. The first spring 18 is wound around the lever shaft 12, and has one end inserted into the third hole 28 of the lever plate 14 while the other end is inserted into a slot 30 formed on a side surface 26 of the pressing plate 16. The first spring 18 is a torsion spring. The second spring 24 has one end inserted into the fourth hole 36 of the lever plate 14 and the other end inserted into a fifth hole 44 formed on a protrusion 42 which protrudes from a body side frame 40. The second spring 24 is a tension coil spring, and acts to return the lever plate 14 to its original position.

Following is a description of the operation of the envelope pressing device in the printer with reference to the drawings.

In the state where the pressing plate 16 is hinge-connected to the body frame 46 and keeps its balance by means of the springs 18 and 24 as shown in FIG. 2, if the paper cassette 50 is mounted on a lower portion of the printer (not shown) under the lever plate 14, the protrusion 54 of the paper cassette 50 contacts a lower end of the lever plate 14. Then, the lever plate 14 moves in the direction in which the paper cassette 50 advances, and the pressing plate 16 interlockingly moves downward under the force of the first spring 18 wound around the lever shaft 12 so as to press against the envelopes 52 loaded in the paper cassette 56 (see FIG. 3).

The pressing plate 16 is set to a state where it can move freely around the hinge shaft 48. Plate 16 presses down on the upper surface of the envelope stack 52 mounted on the paper plate 56 under the tensile force of the first spring 18. The pressure of the pressing plate 16 can be controlled by application of the tensile force of the first spring 18.

When the paper cassette 50 retreats, the lever plate 14 is detached from the protrusion 54 of the paper cassette 50 due to the resilient returning action of the second spring 24, and returns to its original position as shown in FIG. 2. Hence, the first spring 18 exerts a restoring force on the pressing plate 16, thereby returning the pressing plate 16 to its original position as shown in FIG. 2. The pressing plate 16, which is thus lifted upward around the hinge shaft 48, is set to a standby state for pressing down on the envelopes 52 in the paper plate 56 whenever the cassette 50 is reloaded.

As described above, the envelope pressing device according to the present invention presses down on the upper surface of an envelope stack merely as a result of insertion of a paper cassette, into the printer, thereby preventing concurrent transfer of plural envelopes and envelope jam, while further contributing to reliable paper feeding.

While the present invention has been described in detail with reference to the specific embodiment, it is a mere exemplary application. Thus, it is to be clearly understood that many variations can be made by anyone skilled in the art within the scope and spirit of the present invention.

What is claimed is:

1. An envelope pressing device in a printer having a paper cassette which is loaded with a plurality of envelopes and which feeds the envelopes, one by one, by means of a pickup roller, said device comprising:

a hinge shaft rotatably connected to a lower surface of a body frame of the printer;

a pressing plate rotatably connected to the hinge shaft for pressing down on the envelopes, said pressing plate having first and second holes of a predetermined size formed on respective side surfaces thereof and a slot formed on one side surface thereof;

a lever shaft inserted into the first and second holes;

a lever plate fixed to an end of the lever shaft and having a third hole formed on a side surface thereof and a fourth hole formed below the third hole;

a first spring wound around the lever shaft and having a first end inserted into the third hole and a second end inserted into the slot of the pressing plate; and a second spring having a first end inserted into the fourth hole and a second end connected to a side surface of the body frame for returning the lever shaft to an original position.

2. The envelope pressing device of claim 1, further comprising first and second protrusions formed on respective ends of one side of the pressing plate and combined with the hinge shaft.

3. The envelope pressing device of claim 1, further comprising grooves of a predetermined size formed around an outer circumference at respective end portions of the lever shaft in contact with the first and second holes, and snap rings which fit around the grooves.

4. The envelope pressing device of claim 1, wherein the body frame includes a protrusion which has a fifth hole formed therein, and the second end of said second spring fits into said fifth hole.

5. The envelope pressing device of claim 1, wherein a lower portion of said lever plate contacts a protruding portion of the paper cassette when the paper cassette is inserted into the printer.

6. The envelope pressing device of claim 5, wherein said lever plate moves in a direction in which the paper cassette moves when the paper cassette is inserted into the printer.

7. The envelope pressing device of claim 6, wherein said pressing plate interlockingly moves downward under a force of said first spring so as to press against the plurality of envelopes loaded in the paper cassette.

8. The envelope pressing device of claim 5, wherein said lever plate disengages from the protruding portion of the paper cassette when the paper cassette is withdrawn from the printer.

9. The envelope pressing device of claim 8, wherein said pressing plate returns to an original position by a restoring force of said first spring when the paper cassette is withdrawn from the printer.

10. The envelope pressing device of claim 5, wherein said pressing plate returns to an original position by a restoring force of said first spring when the paper cassette is withdrawn from the printer.

11. The envelope pressing device of claim 1, wherein said lever plate moves in a direction in which the paper cassette moves when the paper cassette is inserted into the printer.

12. The envelope pressing device of claim 11, wherein said pressing plate interlockingly moves downward under a force of said first spring so as to press against the plurality of envelopes loaded in the paper cassette.

13. The envelope pressing device of claim 1, wherein said lever plate disengages from a protruding portion of the paper cassette when the paper cassette is withdrawn from the printer.

14. The envelope pressing device of claim 13, wherein said pressing plate returns to an original position by a restoring force of said first spring when the paper cassette is withdrawn from the printer.

15. The envelope pressing device of claim 1, wherein said pressing plate interlockingly moves downward under a force of said first spring so as to press against the plurality of envelopes loaded in the paper cassette when the paper cassette is inserted into the printer.

16. An envelope pressing device in a printer having a cassette which is loaded with envelopes which are fed from the cassette, said device comprising:

a hinge shaft rotatably connected to a body frame of the printer;

a pressing plate connected to the hinge shaft;

a lever shaft mounted between respective side surfaces of said pressing plate;

a lever plate fixed to an end of said lever shaft;

first spring means mounted on said lever shaft for urging said pressing plate downward on the envelopes when the cassette is inserted into the printer; and second spring means extending between said lever plate and the body frame of the printer for returning said lever plate to an original position of said lever plate when the cassette is withdrawn from the printer.

17. The envelope pressing device of claim 16, wherein a lower portion of said lever plate contacts a protruding portion of the paper cassette when the paper cassette is inserted into the printer.

18. The envelope pressing device of claim 16, wherein said lever plate moves in a direction in which the paper cassette moves when the paper cassette is inserted into the printer.

19. The envelope pressing device of claim 16, wherein said pressing plate interlockingly moves downward under a force of said first spring means so as to press against the envelopes loaded in the paper cassette.

20. The envelope pressing device of claim 16, wherein said pressing plate returns to an original position by a restoring force of said first spring means when the paper cassette is withdrawn from the printer.

* * * * *